US010062539B2

(12) United States Patent
Yanagisawa et al.

(10) Patent No.: US 10,062,539 B2
(45) Date of Patent: Aug. 28, 2018

(54) ANODE AND X-RAY GENERATING TUBE, X-RAY GENERATING APPARATUS, AND RADIOGRAPHY SYSTEM THAT USE THE ANODE

(71) Applicant: CANON KABUSHIKI KAISHA, Tokyo (JP)

(72) Inventors: Yoshihiro Yanagisawa, Fujisawa (JP); Shuji Yamada, Abiko (JP); Takao Ogura, Yokohama (JP); Nobuhiro Ito, Yamato (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 108 days.

(21) Appl. No.: 15/000,523

(22) Filed: Jan. 19, 2016

(65) Prior Publication Data

US 2016/0225572 A1 Aug. 4, 2016

(30) Foreign Application Priority Data

Feb. 4, 2015 (JP) ..... 2015-019842

(51) Int. Cl.
*H01J 35/08* (2006.01)
*H01J 35/16* (2006.01)

(52) U.S. Cl.
CPC ..... *H01J 35/08* (2013.01); *H01J 35/16* (2013.01); *H01J 2235/081* (2013.01); *H01J 2235/083* (2013.01); *H01J 2235/186* (2013.01)

(58) Field of Classification Search
CPC ..... H01J 2235/081; H01J 35/08; H01J 35/16; H01J 2235/186; H01J 2235/087; H01J 2235/083; H01J 2235/086
See application file for complete search history.

(56) References Cited

U.S. PATENT DOCUMENTS

| | | | |
|---|---|---|---|
| 8,472,585 | B2 | 6/2013 | Ogura et al. |
| 9,036,788 | B2 | 5/2015 | Ueda et al. |
| 9,230,774 | B2 | 1/2016 | Yanagisawa et al. |
| 9,251,995 | B2 | 2/2016 | Ogura et al. |
| 2012/0307974 | A1 | 12/2012 | Yamazaki et al. |

(Continued)

FOREIGN PATENT DOCUMENTS

| | | | |
|---|---|---|---|
| JP | 2013-51156 A | 3/2013 | |
| JP | WO 2013031423 A1 * | 3/2013 | ..... G01N 23/04 |

OTHER PUBLICATIONS

U.S. Appl. No. 14/926,666, filed Oct. 29, 2015.
U.S. Appl. No. 14/958,264, filed Dec. 3, 2015.

*Primary Examiner* — Glen Kao

(74) *Attorney, Agent, or Firm* — Fitzpatrick, Cella, Harper & Scinto

(57) ABSTRACT

Provided is an anode capable of keeping the X-ray dose steady in an X-ray generating tube by preventing a crack in a connecting electrode layer, which electrically connects a target layer and an anode member. The anode includes a first bonding boundary where the connecting electrode layer, which electrically connects the target layer and the anode member, is bonded to a supporting substrate of a target, and a second bonding boundary where the connecting electrode layer is bonded to the anode member in which the connecting electrode layer is formed so that the first bonding boundary and the second bonding boundary are on the same side with respect to the connecting electrode layer.

19 Claims, 7 Drawing Sheets

(56) References Cited

U.S. PATENT DOCUMENTS

| | | | | |
|---|---|---|---|---|
| 2014/0140480 | A1* | 5/2014 | Ogura ..... | G01N 23/04<br>378/62 |
| 2014/0211919 | A1 | 7/2014 | Ogura et al. | |
| 2014/0369470 | A1 | 12/2014 | Ukiyo et al. | |
| 2015/0201482 | A1 | 7/2015 | Yanagisawa et al. | |

* cited by examiner

ANODE AND X-RAY GENERATING TUBE, X-RAY GENERATING APPARATUS, AND RADIOGRAPHY SYSTEM THAT USE THE ANODE

BACKGROUND OF THE INVENTION

Field of the Invention

The present invention relates to a radiography system applicable to medical equipment, nondestructive testing apparatus, and the like, an X-ray generating apparatus for use in the system, and an X-ray generating tube for use in the apparatus, and more particularly, to an anode thereof.

Description of the Related Art

In an imaging system using an X-ray, in general, an X-ray generating tube is configured to control the trajectory of electrons emitted from a cathode such as a filament with the use of a control electrode, and then accelerate the electrons toward an anode to which an electric potential higher than that of the cathode is applied. The accelerated electrons collide with a target layer formed in the anode, thereby generating an X-ray. The generated X-ray is emitted to the outside of the X-ray generating tube through a transmitting window to irradiate an irradiation object, and the X-ray transmitted through the irradiation object is detected by an X-ray detector, to thereby take a picture of or examine the interior of the irradiation object. If the electrons that collide with the target layer stay in the target layer, the lingering electrons may invite the destabilization of the electron beam trajectory and a drop of the withstand voltage in the X-ray generating tube, which are known as phenomena observed at the time of charging up and in some cases make it difficult to keep the X-ray dose steady. It is therefore a general opinion that the electrons that collide with the target layer need to be led into an electrical conductive path set in advance. An electrical conductive path for electrons is disclosed in Japanese Patent Application Laid-Open No. 2013-51156 in the form of a conductive layer electrically connected to an anode member to which a supporting substrate of a target layer is mounted and to the target layer.

The "X-ray generation efficiency", an efficiency at which an X-ray is generated by a collision between electrons and a target layer in an X-ray generating tube, is about 1%, and most of the energy input to the target layer is transformed into heat, thus raising temperature in the vicinity of the target layer during the generation of an X-ray. Controlling the generation/non-generation of an X-ray in the course of driving the X-ray generating tube equals controlling the collision of electrons with the target layer, and repeating the generation/non-generation of an X-ray accordingly means repeated rises/drops in the temperature of the target layer. As a result, not only the target layer but also a supporting substrate of the target layer, an anode member, and a conductive layer connected to the target layer and to the anode member repeatedly rise and drop in temperature, and expand and shrink at thermal expansion coefficients of their respective materials. In a configuration disclosed in Japanese Patent Application Laid-Open No. 2013-51156, an end of the conductive layer, which is a thin film, is sandwiched between the anode member, which is a bulk-shaped structural member, and the target supporting substrate. The conductive layer and the anode member are bonded to each other and the conductive layer and the target supporting substrate are bonded to each other in this configuration. The repeated rises/drops in temperature at the end portion therefore causes the concentration of stress and the easing of stress repeatedly on bonding boundaries where the conductive layer is bonded to other members, and may result in a crack in the conductive layer, which is a thin film. When a crack is formed in the conductive layer, the conductivity of the conductive layer drops, and the resultant destabilization of a prescribed anode potential and lingering of electrons in the target layer can present difficulties in keeping the X-ray dose steady.

SUMMARY OF THE INVENTION

An object of the present invention is to provide an anode capable of keeping the X-ray dose steady in an X-ray generating tube by preventing a crack in a conductive layer that electrically connects a target layer and an anode member. Another object of the present invention is to provide a highly reliable X-ray generating apparatus and radiography system by building an X-ray generating tube that is stable in X-ray dose with the use of the anode.

According to a first embodiment of the present invention, there is provided an anode including: a target layer configured to generate an X-ray when an electron beam is irradiated thereon; a supporting substrate configured to support the target layer; an anode member having a tubular shape, which is configured to hold the supporting substrate inside; and a connecting electrode layer configured to electrically connect the target layer and the anode member, in which the connecting electrode layer includes a first bonding boundary where the connecting electrode layer is bonded to the supporting substrate and a second bonding boundary where the connecting electrode layer is bonded to the anode member, and in which the first bonding boundary and the second bonding boundary are on the same side with respect to the connecting electrode layer.

According to a second embodiment of the present invention, there is provided an X-ray generating tube including: the anode of the first embodiment the present invention; a cathode including an electron emitting source configured to emit electrons toward the target layer of the anode; and an insulating tube configured to insulate the anode and the cathode, and to form a vacuum container together with the anode and the cathode.

According to a third embodiment of the present invention, there is provided an X-ray generating apparatus including: the X-ray generating tube of the second embodiment of the present invention; and a drive circuit configured to apply a tube voltage between the cathode and the anode of the X-ray generating tube.

According to a fourth embodiment of the present invention, there is provided a radiography system including: the X-ray generating apparatus of the third embodiment of the present invention; an X-ray detecting apparatus configured to detect an X-ray that has been emitted from the X-ray generating apparatus and transmitted through a subject; and a system control apparatus configured to control the X-ray generating apparatus and the X-ray detecting apparatus in a coordinated manner.

Further features of the present invention will become apparent from the following description of exemplary embodiments with reference to the attached drawings.

BRIEF DESCRIPTION OF THE DRAWINGS

FIG. 1A is a plan view viewed from the electron beam passage side and FIG. 1B is a sectional view in a tube axial direction that is taken along the line 1B-1B in FIG. 1A.

FIG. 2A is a partial enlarged sectional view of the vicinity of a connection portion that connects a connecting electrode layer to an anode member and FIG. 2B is a partial enlarged sectional view of the vicinity of a connection portion that connects the connecting electrode layer to a target layer.

DESCRIPTION OF THE EMBODIMENTS

Exemplary embodiments of the present invention are described in detail below with reference to the drawings. The dimensions, materials, shapes, and relative placement of components described in the embodiments are not to limit the scope of the present invention. Well known technologies in the technical field of the present invention are applied to parts that are not particularly mentioned herein or not particularly shown in a drawing. In the present invention, a "tube axial direction" and a "tube radial direction" are the tube axial direction and tube radial direction of an insulating tube that is described later. In the present invention, "bonded" means a state in which two layers are fixed to each other via a diffusion layer without using an external force, and a "bonding boundary" means a boundary between two layers bonded to each other in the manner described above.

<Anode>

Figure 1A:
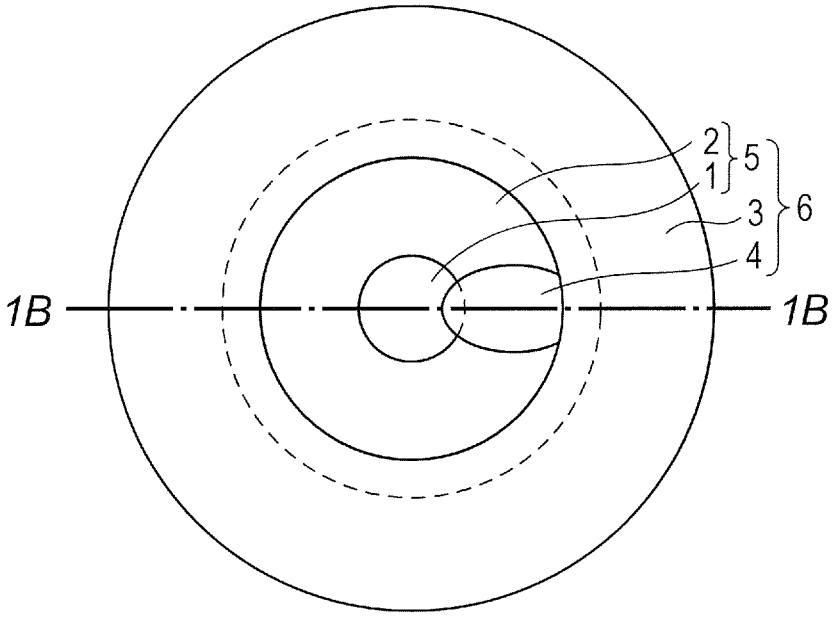
FIG. 1A and FIG. 1B are schematic views for illustrating an anode according to an embodiment of the present invention.
Figure 1B:
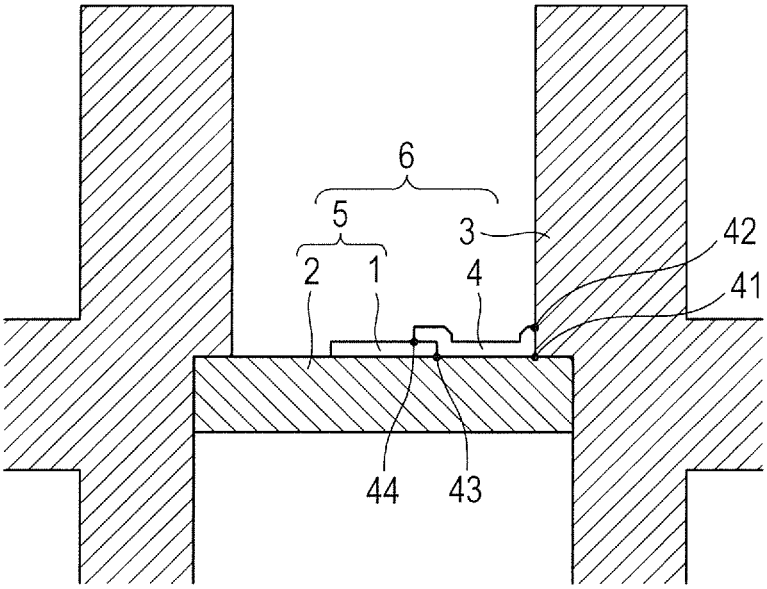

The configuration of an anode of the present invention is described through an embodiment with reference to FIG. 1A and FIG. 1B. FIG. 1A is a plan view of an anode according to an embodiment of the present invention that is viewed from an electron beam passage side. FIG. 1B is a sectional view in a tube axial direction that is taken along the line 1B-1B in FIG. 1A and that includes a tube axis of an insulating tube, which is described later.

As illustrated in FIG. 1A and FIG. 1B, an anode 6 of the present invention includes a target 5 and an anode member 3, which has a tubular shape and holds the target 5. The target 5 includes a target layer 1 and a supporting substrate 2, which supports the target layer 1. The target layer 1 is positioned closer to the center in a tube radial direction than an opening in the anode member 3 is, and the present invention therefore includes a connecting electrode layer 4, which electrically connects the target layer 1 and the anode member 3. The anode member 3 is bonded on an inner surface of the opening and around the circumference of the supporting substrate 2 to have a function of mechanically holding the target 5 and a hermetic sealing function.

The target 5 is a transmissive target in which the target layer 1 is irradiated with electrons and an X-ray is taken out for operation from a surface (an X-ray emitting surface) of the supporting substrate 2 that is opposite from a supporting surface where the target layer 1 is supported. The tube interior of the tubular anode member 3 forms two passages one of which faces the target layer 1 to serve as an electron beam passage, and the other of which serves as an X-ray retrieval passage.

The anode member 3 is formed from a conductive material that blocks X-rays. Specifically, tantalum, molybdenum, and tungsten, which are capable of blocking X-rays that are generated at 30 kV to 150 kV, are preferred materials of the anode member 3.

The target layer 1 is a part configured to generate an X-ray with irradiation of an electron beam, and contains as a target metal a metal element that is high in atomic number, melting point, and relative density. The target metal is selected from among metal elements with an atomic number of 42 or higher. A target metal that is preferred from the viewpoint of affinity to the supporting substrate 2 is selected from the group consisting of tantalum, molybdenum, and tungsten of which carbides have a negative standard free energy of formation. The target metal may be contained in the target layer 1 as a single-component pure metal or an alloy composition pure metal, or as a metal compound such as a carbide, nitride, or oxynitride of the metal. The thickness of the target layer 1 is selected from a range of 0.5 μm or more and 15 μm or less. The lower limit and upper limit to the thickness of the target layer 1 are determined from the viewpoints of securing the X-ray output intensity and reducing the boundary stress, respectively. A preferred range of the target layer thickness is 2 μm or more and 8 μm or less.

The supporting substrate 2 is given a contour of a flat board such as a rectangular solid, a disc, or a truncated cone that has, as illustrated in FIG. 1A and FIG. 1B, a supporting surface for supporting the target layer 1 and an X-ray emitting surface on the opposite side of the supporting surface. One surface of the supporting substrate 2 that has a disc shape is 2 mm or more and 10 mm or less in width, namely, diameter, so that the target layer 1 large enough to form a necessary electron beam focal point can be provided. The disc-shaped supporting substrate 2 is given a thickness of 0.2 mm or more and 3 mm or less to obtain heat transmission characteristics in a surface direction and X-ray transmittance. In the case of a diamond substrate shaped like a rectangular solid, the diameter range given above is read as a length range for the short sides and long sides of a surface of the rectangular solid. The supporting substrate 2 that is preferred in the present invention is smaller in coefficient of thermal expansion than the anode member 3 and is made of diamond, which is a typical low-coefficient of thermal expansion material.

The supporting substrate 2 and the anode member 3 in the anode 6 are hermetically bonded in vacuum by brazing. The brazing material used in the brazing is an alloy that contains gold, silver, copper, tin, or the like, and an alloy composition suitable for the materials of the members to be bonded is selected in order to guarantee a solid bond between the different materials of the supporting substrate 2 and the anode member 3. In the case where a non-metal material such as diamond or a ceramic is used as a material of the supporting substrate 2, it is preferred to perform metallizing processing on the side surface of the supporting substrate 2 and form a metal under layer (not shown) having a metal layer and an intermediate layer in order to accomplish brazing that is more solid and highly airtight. A material favorable for the metal under layer is, for example, a metal that contains Ti, or Mo—Mn. The metal under layer is not an indispensable component of the X-ray generating tube of the present invention.

The supporting substrate 2 and the anode member 3 are brazed by filling the gap between the two, or a space specially provided to arrange the brazing material, with the brazing material. It is preferred to arrange the brazing materials in a ring pattern on the side surface of the supporting substrate 2 side by side. Precise processing that makes the gap between the supporting substrate 2 and the anode member 3 as small as possible, about a few μm to 30 μm, is performed, and the amount of the brazing material with which the gap is filled is also precisely adjusted so that the fluid material does not flow over to the target layer 1 while taking care that airtightness is not compromised by a shortage of the brazing material. Thereafter, the supporting substrate 2 and the anode member 3 are brazed at a temperature suitable for the brazing member that is used. In the case where a brazing filler metal BAg-8 (Japanese Industrial Standard: JIS) is used, brazing can be performed at 780° C. to 900° C. and, in order to prevent oxidization of the member, vacuum, an inert gas atmosphere, or a reductive gas atmosphere is preferred as an environment in which the brazing is performed. The brazing material needs to seep into the narrowest space in order to secure a high level of airtightness in vacuum sealing. A material high in fluidity, particularly on a metal surface, is therefore preferred for the brazing material. The side surface of the supporting substrate 2 and the anode member 3 are hermetically bonded in this manner. The target layer 1 described above may be formed in a later step by sputtering or vapor deposition.

In FIG. 1A and FIG. 1B, the opening inside the anode member 3 is formed so that the X-ray retrieval passage is wider than the electron beam passage by making a portion of the opening protrude inward so as to face the supporting surface of the supporting substrate 2. A protruding portion of the anode member 3 overlaps with the supporting surface of the supporting substrate 2. The anode member 3 and the supporting substrate 2 in this region may or may not be bonded. In the case where the two are to be bonded, the brazing material is applied to this region as well or the brazing material that is used to bond the side surfaces of the supporting substrate 2 to the anode member 3 is caused to overflow to the supporting surface side of the supporting substrate 2.

The connecting electrode layer 4 is further formed in the anode 6 as an electrical conductive path for preventing electrons that collide with the target layer 1 from staying. A material that is preferred for the connecting electrode layer 4 in terms of preventing a crack is a material smaller in Young's modulus than the target layer 1, the supporting substrate 2, and the anode member 3. A preferred combination is one of tungsten, tantalum, and molybdenum for the target layer 1 and the anode member 3, diamond for the supporting substrate 2, and one of aluminum, titanium, and copper for the connecting electrode layer 4. A conductive inorganic adhesive material such as Pyro-Duct 597-A (melting point: 927° C.), which is a heat-resistant adhesive containing silver particles as the base and manufactured by Aremco Products., Inc., is a material preferred to be used as the connecting electrode layer 4 in combination with the target layer 1, anode member 3, and supporting substrate 2 described above. Microdispensing, for example, can be selected as a method of forming this material. A sufficient thickness of the connecting electrode layer 4 is about several μm to 10 μm. The anode of the present invention in which an electrical conductive path is secured while covering a part of the target layer 1 and a part of the anode member 3 is formed in the manner described above.

Figure 2A:
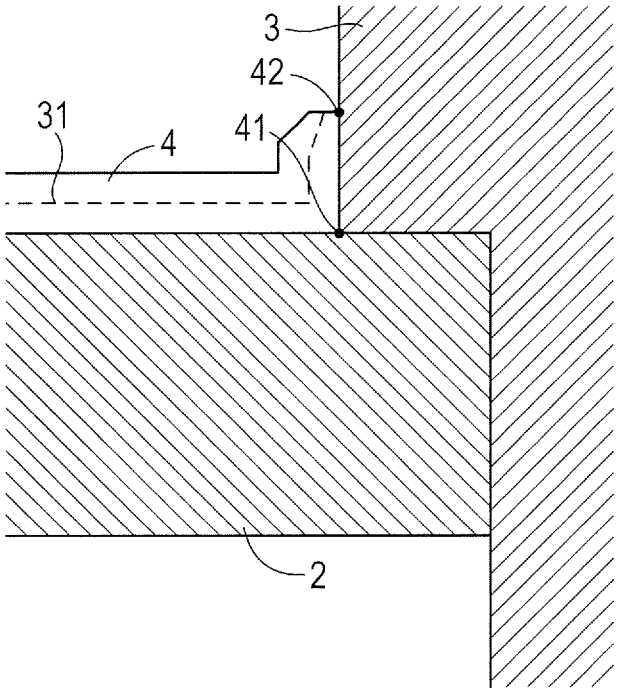
FIG. 2A and FIG. 2B are enlarged views of FIG. 1B.
Figure 2B:
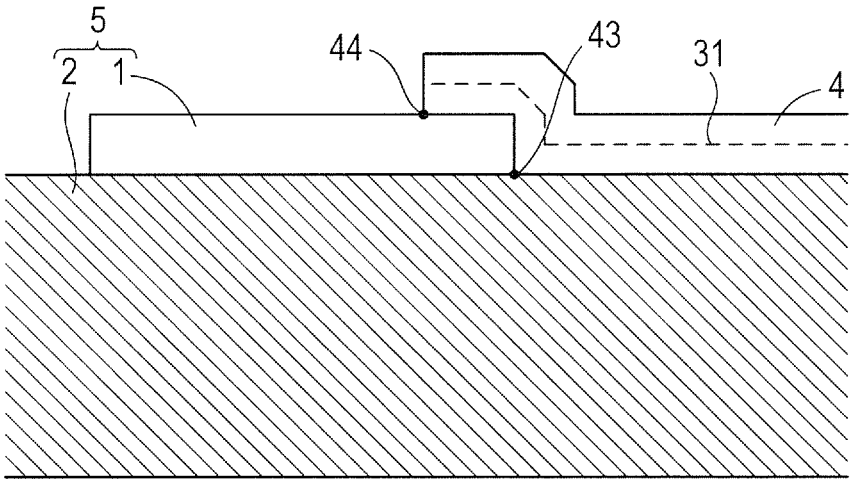

FIG. 2A and FIG. 2B are partial enlarged sectional views of FIG. 1B. FIG. 2A is a view of the vicinity of a connection portion that connects the connecting electrode layer 4 and the anode member 3. FIG. 2B is a view of the vicinity of a connection portion that connects the connecting electrode layer 4 and the target layer 1. In the anode 6 of the present invention, a film serving as the connecting electrode layer 4, which electrically connects the target layer 1 and the anode member 3, is formed after the target 5 is mounted to the interior of the tube of the anode member 3. When forming the film of the connecting electrode layer 4, the connecting electrode layer 4 is patterned so as to partially cover the target layer 1 and the anode member 3, thereby ensuring electrical connection to the target layer 1 and to the anode member 3. As a result, an end portion of the connecting electrode layer 4 on the side where the connecting electrode layer 4 is bonded to the anode member 3 partially covers an inner side surface of the anode member 3 by rising up along the inner side surface.

In the present invention, a first bonding boundary where the connecting electrode layer 4 is bonded to the supporting substrate 2 and a second bonding boundary where the connecting electrode layer 4 is bonded to the anode member 3 are on the same side with respect to the connecting electrode layer 4 as illustrated in FIG. 2A. The first bonding boundary is a boundary that stretches from a point denoted by a reference symbol 41 to a point denoted by a reference symbol 43 in FIG. 1B. The second bonding boundary is a boundary that stretches from the point denoted by the reference symbol 41 to a point denoted by a reference symbol 42 in FIG. 1B and FIG. 2A. Thus, the end portions of the connecting electrode layer 4 are not sandwiched between the supporting substrate 2 and the anode member 3. In other words, a surface of the connecting electrode layer 4 that is opposite from a surface supported by the supporting substrate 2 is not bonded to the anode member 3, and the anode member 3 does not have a surface that faces this surface of the connecting electrode layer 4. This means that the anode member 3 does not have a portion protruding toward the supporting surface side of the supporting substrate 2.

The second bonding boundary does not cut across an imaginary intermediate plane 31, which is positioned in the middle of the thickness direction of the connecting electrode layer 4, and it can also be phrased that the first bonding boundary and the second bonding boundary are continuous on the same side with respect to the imaginary intermediate plane 31. The first bonding boundary and the second bonding boundary connect seamlessly to each other at the point denoted by the reference symbol 41 in FIG. 1B and FIG. 2A. The imaginary intermediate plane 31 is an imaginary plane that is formed by linking points in the middle of the thickness direction of the connecting electrode layer 4 and, in the bonding region where the connecting electrode layer 4 is bonded to the anode member 3, an imaginary plane that is formed by linking points in the middle of the shortest distance between the exposed surface of the connecting electrode layer 4 and the anode member 3.

Figure 3A:
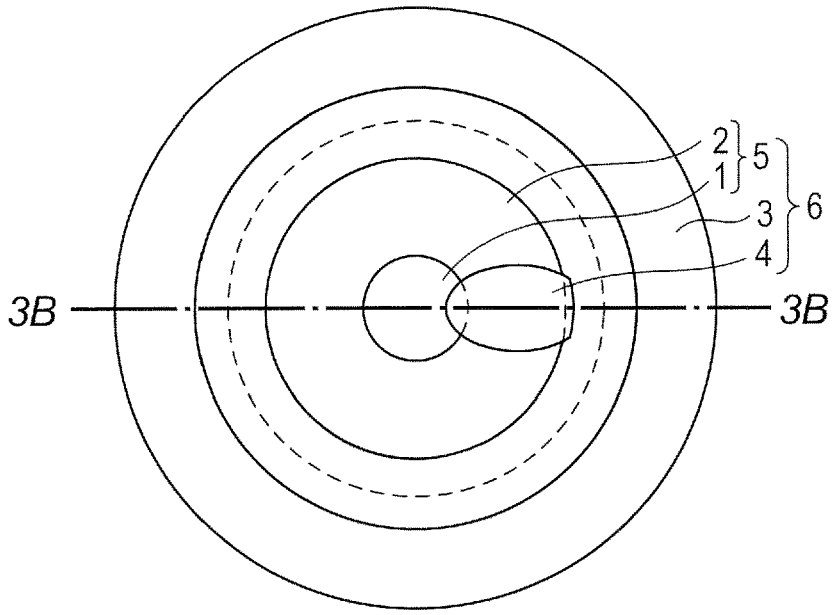
FIG. 3A and FIG. 3B are schematic sectional views for illustrating another structural example of the anode member according to the present invention.
Figure 3B:
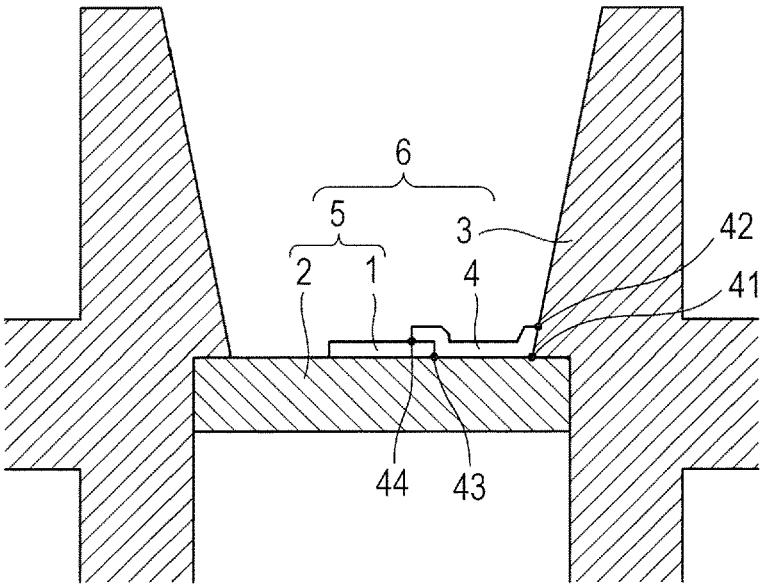

While the electron beam passage inside the anode member 3 has a cylindrical shape in FIG. 1A and FIG. 1B, the anode member 3 in the present invention may be formed so that the opening region gradually increases from the target layer 1 toward the opening on the electron beam incident side as illustrated in FIG. 3A and FIG. 3B. FIG. 3B is a sectional view taken along the line 3B-3B in FIG. 3A.

Figure 4A:
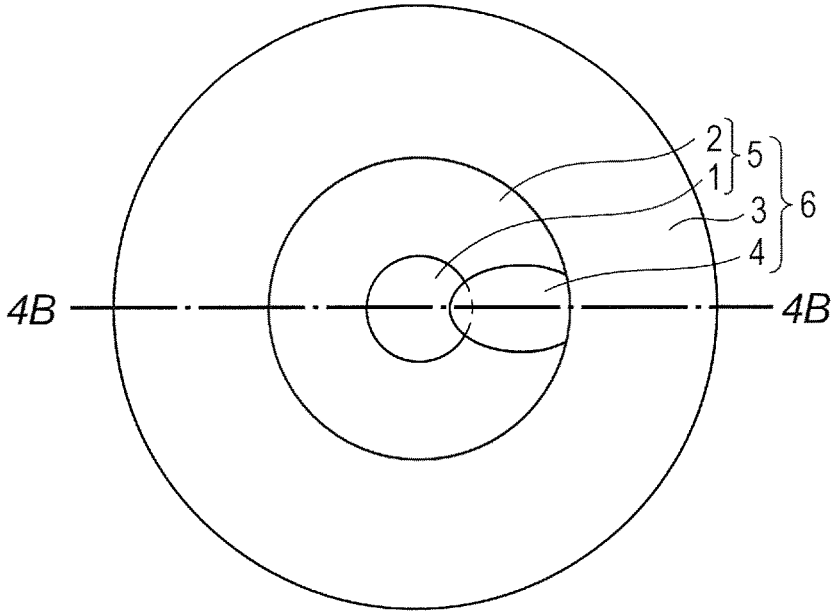
FIG. 4A and FIG. 4B are schematic sectional views for illustrating still another structural example of the anode member according to the present invention.
Figure 4B:
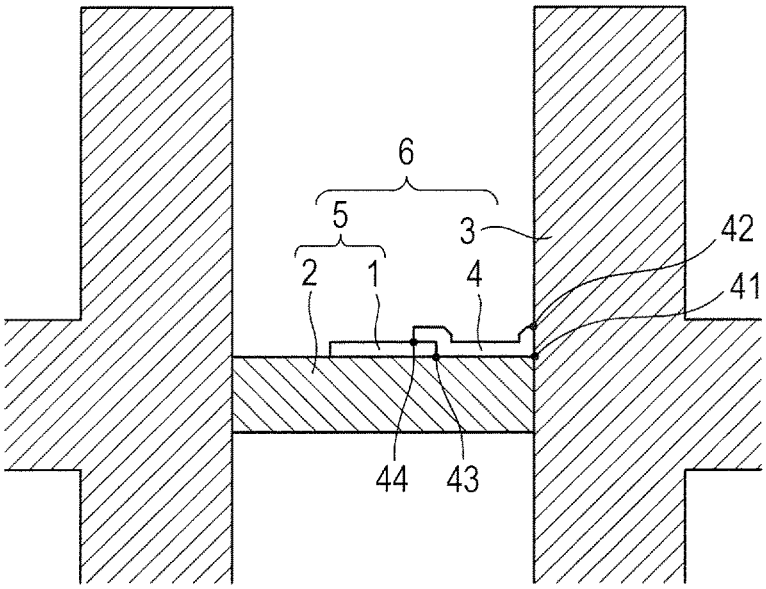

While the anode member 3 in FIG. 1A, FIG. 1B, FIG. 3A and FIG. 3B partially overlaps with the supporting surface of the supporting substrate 2 by making the opening region wider in the X-ray retrieval passage behind the target 5 than the electron beam passage in front of the target 5, the present invention is not limited to this mode. For example, the opening region inside the anode member 3 may have a uniform width along the passage in front of the target 5 and the passage behind the target 5 as illustrated in FIG. 4A and FIG. 4B. FIG. 4B is a sectional view taken along the line 4B-4B in FIG. 4A.

The connecting electrode layer 4 in FIG. 1A, FIG. 1B, FIG. 3A and FIG. 3B electrically connects the target layer 1 and the anode member 3 by partially covering the two. In the present invention, the supporting surface of the supporting substrate 2 may instead be covered entirely, so that the target layer 1 is connected to the anode member 3 in a ring pattern.

An end portion of the target layer 1 is covered by the connecting electrode layer 4 in the present invention by forming the target layer 1 on the supporting substrate 2 prior to the step of forming the film of the connecting electrode layer 4. This puts a third bonding boundary where the connecting electrode layer 4 is bonded to the target layer 1 on the same side as the first bonding boundary and the second bonding boundary with respect to the connecting electrode layer 4. The third bonding boundary is a boundary that stretches from the point denoted by the reference symbol 43 to a point denoted by the reference symbol 44 in FIG. 1B and FIG. 2B. Employing the structure in which the connecting electrode layer 4 is not sandwiched between the target layer 1 and the supporting substrate 2 thus reduces stress on the boundaries between the members, despite the repeated thermal expansion and shrinkage of the members due to repeated temperature rises/drops in X-ray driving. The chance of a crack forming in the target layer 1 and the chance of a minute gap developing between the target layer 1 and the supporting substrate 2 are lowered as a result, and X-ray emission is stabilized.

The ordinal numbers in the first bonding boundary to the third bonding boundary are not used with the intention of limiting the order of film forming steps or the order in which the films are layered.

<X-Ray Generating Tube>

Figure 5:
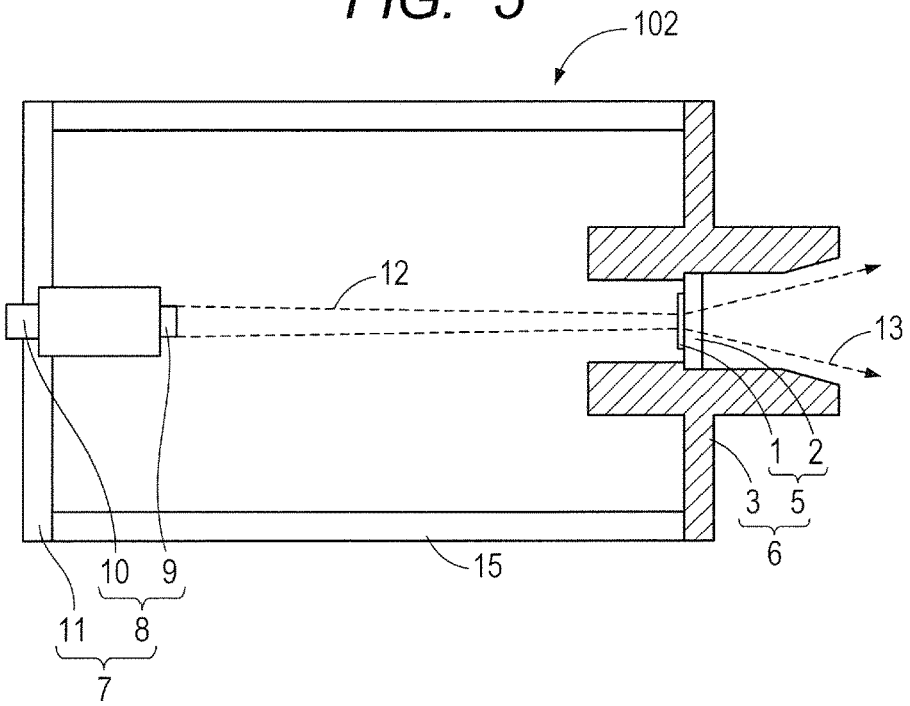
FIG. 5 is a sectional view in a tube axial direction to schematically illustrate the structure of an X-ray generating tube according to an embodiment of the present invention.

The configuration of an X-ray generating tube according to an embodiment of the present invention is illustrated schematically in FIG. 5. FIG. 5 is a schematic sectional view in a tube axial direction of an insulating tube 15 described later that includes the tube axis. For conveniences' sake, the connecting electrode layer 4 is omitted from FIG. 5 and from FIG. 6 to FIG. 8, which are described later. An X-ray generating tube 102 of the present invention includes the anode 6 of the present invention of which an example is illustrated in FIG. 1A and FIG. 1B, and also includes a cathode 7 and the insulating tube 15. The cathode 7 includes an electron emitting source 8, which emits electrons toward the target layer 1. The insulating tube 15 insulates the anode 6 and the cathode 7 from each other and, together with the anode 6 and the cathode 7, forms a vacuum chamber.

The cathode 7 includes the electron emitting source 8, which includes an electron emitting portion 9 and a lead-in terminal 10, and a cathode member 11. The electron emitting portion 9 can be a hot cathode such as a tungsten filament or an impregnated cathode, or a cold cathode such as a carbon nanotube. The electron emitting source 8 can include a grid electrode or an electrostatic lens electrode (not shown) for the purpose of controlling the beam diameter, electron current density, and on/off timing of an electron beam 12.

Figure 6:
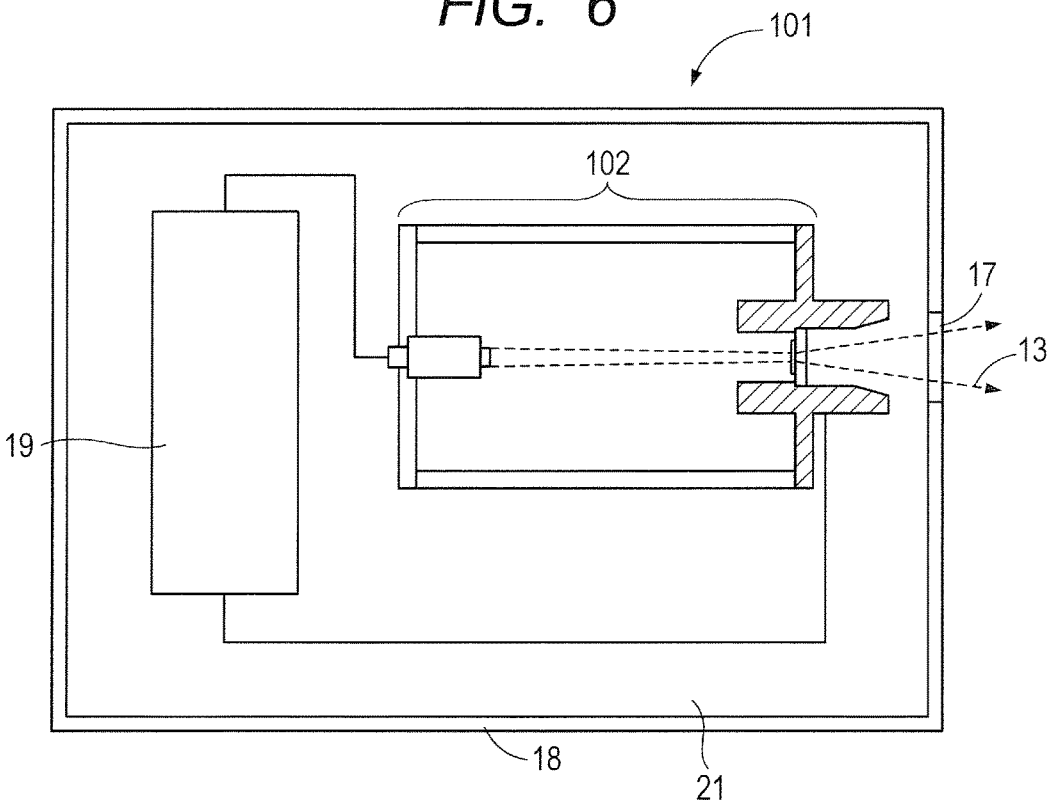
FIG. 6 is a diagram for schematically illustrating the structure of an X-ray generating apparatus according to an embodiment of the present invention.

The X-ray generating tube 102 has in its trunk portion the insulating tube 15 in order to electrically insulate the cathode 7, which is regulated to have a cathode potential, and the anode 6, which is regulated to have an anode potential, from each other. The insulating tube 15 is made from an insulating material such as a glass material or a ceramic material. The insulating tube 15 may have a function of regulating a gap between the electron emitting portion 9 and the target layer 1 as illustrated in FIG. 6.

Preferred materials of the insulating tube 15, the cathode 7, and the anode 6 have air-tightness enough to maintain a certain degree of vacuum and enough solidness to withstand atmospheric pressure. The cathode 7 and the anode 6 are respectively bonded to the opposing ends of the insulating tube 15 via a bonding member, thereby forming a part of the vacuum chamber. The anode 6 is mounted by bonding the outer circumferential edge of a flange portion that is provided along the outer circumference of the anode member 3 to the insulating tube 15. The cathode 7 is mounted by bonding the outer circumferential edge of the cathode member 11 to the insulating tube 15. The supporting substrate 2 similarly forms a part of the vacuum chamber while serving at the same time as a transmitting window through which an X-ray beam 13 generated in the target layer 1 is taken out of the X-ray generating tube 102. A metal material having a coefficient of thermal expansion close to that of the insulating tube 15 is selected for the cathode member 11, which is a constituent member of the vacuum chamber.

The interior space of the X-ray generating tube 102 is vacuum in order to secure the mean free path of the electron beam 12. The degree of vacuum inside the X-ray generating tube 102 is desirably $1\times10^{-4}$ Pa or less, more desirably, $1\times10^{-6}$ Pa or less from the viewpoint of the life-time of the electron emitting source 8. This degree of vacuum can be accomplished by performing vacuum exhaustion with the use of an exhaust pipe and a vacuum pump (not shown) and then sealing the exhaust pipe. A getter (not shown) may also be put in the interior space of the X-ray generating tube 102 for the purpose of maintaining the degree of vacuum.

The X-ray generating tube 102 is configured so that an X-ray is generated by irradiating the target layer 1 with the electron beam 12 emitted from the electron emitting portion 9, which is included in the electron emitting source 8. The target layer 1 and the electron emitting portion 9 are therefore opposed to each other. Electrons contained in the electron beam 12 are accelerated by an accelerating electric field formed in the interior space of the X-ray generating tube 102 which is sandwiched between the anode 6 and the cathode 7 to a level of incident energy necessary to generate an X-ray in the target layer 1.

In the X-ray generating tube 102, an X-ray generated in the target layer 1 is, when necessary, controlled in emission angle by a collimator (not shown) that is disposed in front of the target 5 to be shaped into the X-ray 13. The anode member 3 here can function also as a collimator by having an extended portion with an opening in front of the target 5.

<X-Ray Generating Apparatus>

FIG. 6 is a diagram of an X-ray generating apparatus 101 according to an embodiment of the present invention. The X-ray generating apparatus 101 includes, in a housing container 18 where an X-ray transmitting window 17 is installed, the X-ray generating tube 102 and a drive circuit 19 for driving the X-ray generating tube 102. When the drive circuit 19 applies a tube voltage between the cathode 7 and the anode 6, an electric field is formed between the target layer 1 and the electron emitting portion 9. By setting the tube voltage Va that is suitable for the thickness of the target layer 1 and the type of metal forming the target layer 1, an X-ray type necessary for imaging can be selected.

The housing container 18, which houses the X-ray generating tube 102 and the drive circuit 19, desirably has strength sufficient as a container and excellent heat dissipating properties. The constituent material of the housing container 18 is, for example, a metal material such as brass, iron, or stainless steel.

An excess space in the housing container 18 which remains after the X-ray generating tube 102 and the drive circuit 19 take up spaces in the housing container 18 is filled with an insulating liquid 21. The insulating liquid 21 is a liquid having electrical insulation properties, maintains electrical insulation inside the housing container 18, and serves as a cooling medium for the X-ray generating tube 102. An electrical insulation oil such as a mineral oil, a silicone oil, or a perfluoro-based oil is preferred as the insulating liquid 21.

<Radiography System>

Figure 7:
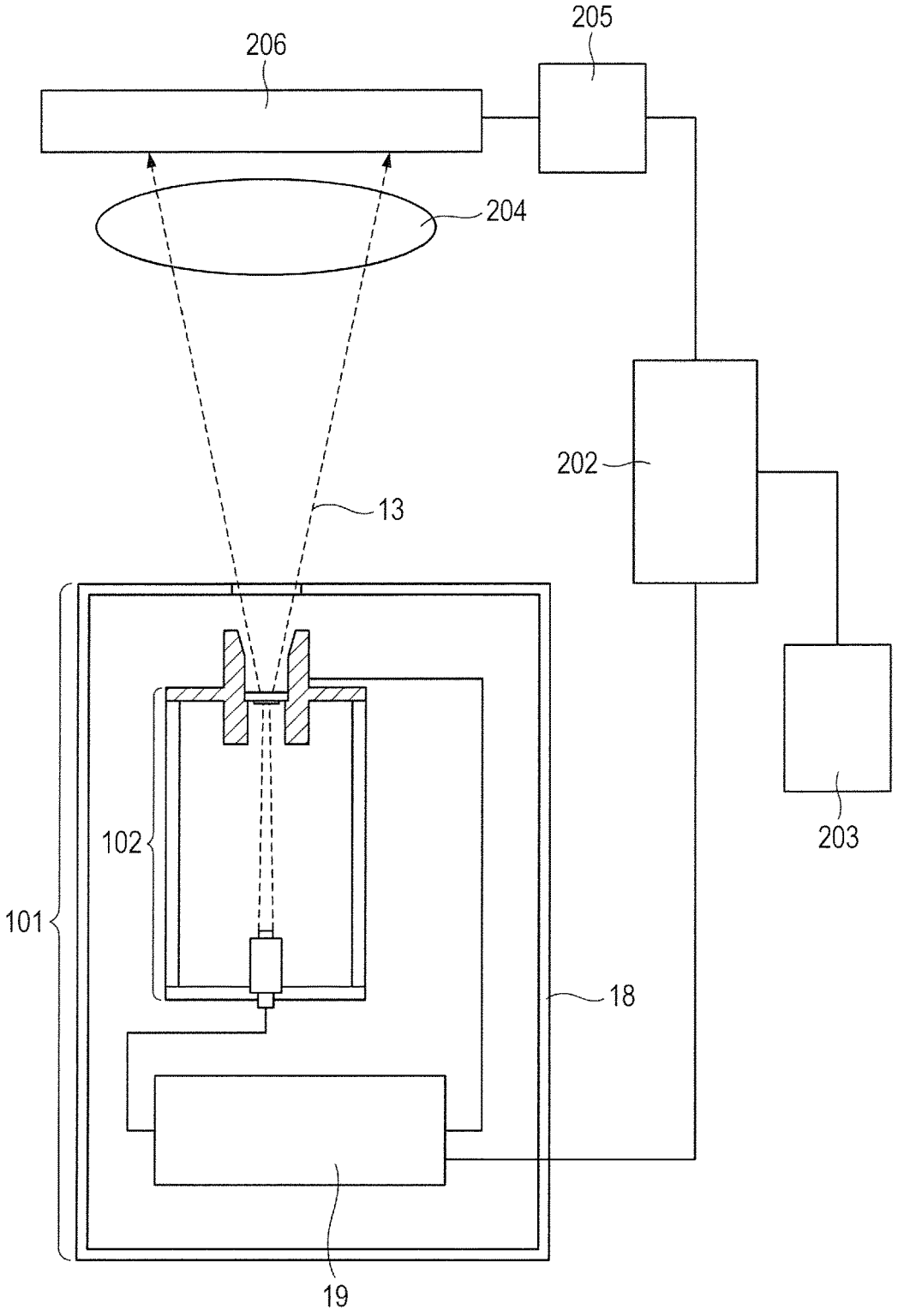
FIG. 7 is a diagram for schematically illustrating the structure of a radiography system according to an embodiment of the present invention.

A structural example of a radiography system of the present invention is described next with reference to FIG. 7.

A system control apparatus 202 controls the X-ray generating apparatus 101 and an X-ray detecting apparatus 206 in an integrated manner. The drive circuit 19 outputs, under control of the system control apparatus 202, various control signals to the X-ray generating tube 102. The drive circuit 19, which is housed in the housing container 18 along with the X-ray generating tube 102 in this embodiment, may be arranged outside the housing container 18. The control signals output by the drive circuit 19 are used to control the emission state of the X-ray 13 emitted from the X-ray generating apparatus 101.

The X-ray 13 emitted from the X-ray generating apparatus 101 is adjusted in irradiation range by a collimator unit (not shown) having a variable aperture, emitted to the outside of the X-ray generating apparatus 101, transmitted through a subject 204, and detected by the X-ray detecting apparatus 206. The X-ray detecting apparatus 206 converts the detected X-ray into image signals, which are output to a signal processing portion 205.

The signal processing portion 205 performs, under control of the system control apparatus 202, given signal processing on the image signals, and outputs the processed image signals to the system control apparatus 202. Based on the processed image signals, the system control apparatus 202 outputs to a display apparatus 203 display signals for displaying an image on the display apparatus 203. The display apparatus 203 displays on a screen an image based on the display signals as a photographed image of the subject 204.

The radiography system of the present invention is applicable to non-destructive testing of an industrial product, and the diagnosis of human and animal pathology.

Example 1

In Example 1, an X-ray generating tube that used the anode 6 of FIG. 1A and FIG. 1B was manufactured, and the X-ray generating apparatus 101 including this X-ray generating tube was further manufactured.

Sumicrystal, which is a synthetic diamond product of Sumitomo Electric Industries, Ltd. and has a diameter of 5 mm and a thickness of 2 mm, was first used for the supporting substrate 2. A metal under layer (not shown) was formed by performing metallizing processing on the side surface 2 of the supporting substrate 2 with the use of a paste containing Ti. Next, the target layer 1 was formed by sputtering tungsten to a thickness of 6 μm for a 3-mm diameter range on a central portion of one surface of the supporting substrate 2. To form this target layer 1, argon gas was used as the carrier gas and a sintered body of tungsten was used as the sputtering target. The supporting substrate 2 on which the target layer 1 had been formed was put inside the anode member 3 made of tungsten, and a brazing material BA-108 manufactured by Toyo Riken Co., Ltd. was used to perform high-temperature brazing at 840° C. in a vacuum atmosphere. A brazed portion (not shown) was thus formed, which was followed by vacuum hermetic sealing. Lastly, Pyro-Duct 597-A was used as the connecting electrode layer 4 to electrically connect the target layer 1 and the anode member 3, thereby completing the anode 6. When connecting the target layer 1 and the anode member 3, a micro-dispenser was used to form the connecting electrode layer 4 so that an end of the target layer 1 was covered with an end of the connecting electrode layer 4 and that a part of the anode member 3 was covered with the other end of the anode member 3.

The X-ray generating tube 102 using the anode 6 thus formed was tested for its static withstand voltage, and revealed to be capable of maintaining a tube voltage of 150 kV for 10 continuous minutes without discharge. The static withstand voltage test in Example 1 is for evaluating the discharge withstand voltage by applying a tube voltage between the anode 6 and the cathode 7 without generating the electron beam from the electron emitting source 8 of the X-ray generating tube 102.

The drive circuit 19 having a tube voltage output portion configured to output the tube voltage between the cathode 7 and the anode 6 was next connected to the X-ray generating tube 102 and housed in the housing container 18 to manufacture the X-ray generating apparatus 101 of FIG. 6.

Figure 8:
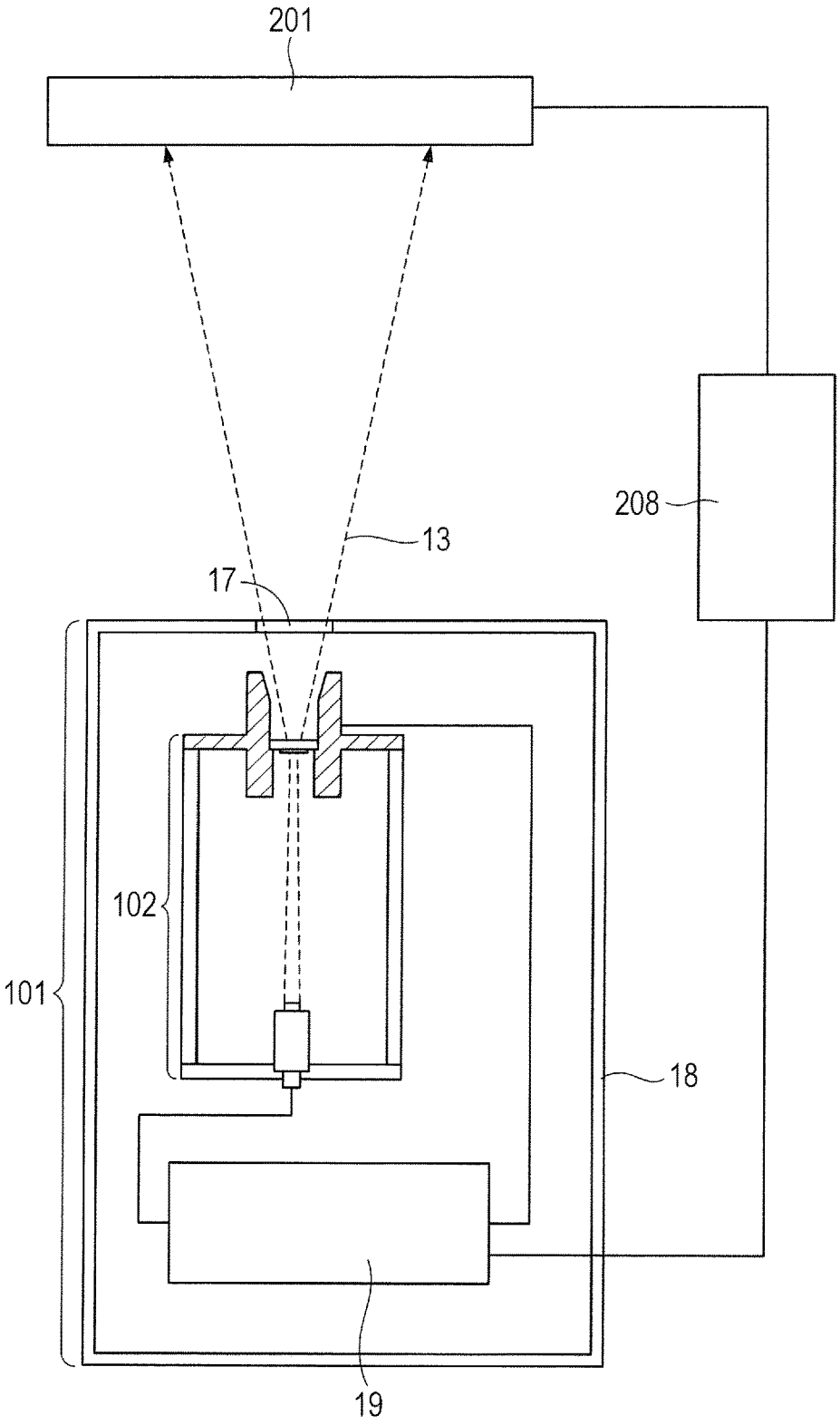
FIG. 8 is a diagram for schematically illustrating the structure of an evaluation system of an X-ray generating apparatus according to Examples of the present invention.

An evaluation system illustrated in FIG. 8 was prepared next in order to evaluate the withstand discharge performance and anode current stability of the X-ray generating apparatus 101. The evaluation system includes a radiation dosimeter 201, which is arranged at 1 m in front of the X-ray transmitting window 17 of the X-ray generating apparatus 101. The radiation dosimeter 201 is connected to the drive circuit 19 via a measurement control apparatus 208 to measure the emission output intensity of the X-ray generating apparatus 101. The X-ray generating apparatus 101 in Example 1 was driven with pulses by repeatedly alternating a 3-second electron irradiation period and a 57-second non-irradiation period, and by setting the tube voltage of the X-ray generating tube 102 to +110 kV and setting the current density of the electron beam with which the target layer 1 was irradiated to 20 mA/mm$^2$. The manufactured X-ray generating apparatus 101 was evaluated for stability and revealed to be capable of stable driving in which fluctuations in X-ray output were within 2% after pulses were applied 5,000 times.

A radiography system was further fabricated with the use of the X-ray generating apparatus 101 of Example 1. In the radiography system, discharge was suppressed and fluctuations in anode current were reduced. Radiographic images having no shot-to-shot fluctuations in shooting quality and having a high SN ratio were obtained as a result.

The anode 6 was dismantled after the drive evaluation to observe the target 5. The observation revealed no cracks in the connecting electrode layer 4 and the target layer 1 and no gap between the target layer 1 and the supporting substrate 2, thereby confirming that the target 5 maintained the form the target 5 had been in at the time of formation.

Example 2

An X-ray generating tube and an X-ray generating apparatus were fabricated and evaluated the same way as in Example 1, except that the anode member 3 of FIG. 3A and FIG. 3B having the electron beam passage widening toward the electron emitting portion was used. The anode 6 used in Example 2 is improved in the reliability of electrical connection because the electron beam passage of the anode member 3 opens wider outward in the tube radial direction, which makes the area of contact between the anode member 3 and the connecting electrode layer 4 large. In Example 2 also, there was no problem with regards to static withstand voltage and stable driving was accomplished. Radiographic images having no shot-to-shot fluctuations in shooting quality and having a high SN ratio were obtained as a result.

The anode 6 was dismantled after the drive evaluation to observe the target 5. The observation revealed no cracks in the connecting electrode layer 4 and the target layer 1 and no gap between the target layer 1 and the supporting substrate 2, thereby confirming that the target 5 maintained the form the target 5 had been in at the time of formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-019842, filed Feb. 4, 2015, which is hereby incorporated by reference herein in its entirety.

What is claimed is:

1. An anode for an X-ray generating tube comprising:

a target layer configured to generate an X-ray when an electron beam is irradiated thereon;

a supporting substrate configured to support the target layer;

an anode member having a tubular shape, which is configured to hold the supporting substrate inside; and a connecting electrode layer configured to electrically connect the target layer and the anode member, wherein the connecting electrode layer comprises a first bonding boundary where the connecting electrode layer is bonded to the supporting substrate and a second bonding boundary where the connecting electrode layer is bonded to the anode member, and wherein the first bonding boundary and the second bonding boundary are on the same side with respect to an imaginary intermediate plane associated with an aggregation of a plurality of midpoints along the connecting electrode layer, each of which is a midpoint in a thickness direction of the connecting electrode layer, where any portion of the imaginary intermediate plane is perpendicular to the thickness direction of a corresponding region of the connecting electrode layer.

2. The anode according to claim 1, wherein the connecting electrode layer has a surface supported by the supporting substrate and an opposite surface from the supported surface, and the opposite surface is not bonded to the anode member.

3. The anode according to claim 2, wherein the anode member has no surface that faces the opposite surface of the connecting electrode layer which is opposite from the connecting electrode layer surface supported by the supporting substrate.

4. The anode according to claim 1, wherein the second bonding boundary is prevented from cutting across the imaginary intermediate plane, and the second bonding boundary is continuous from the first bonding boundary.

5. The anode according to claim 1, wherein the connecting electrode layer is smaller in Young's modulus than any of the anode member, the supporting substrate, and the target layer.

6. The anode according to claim 5, wherein the supporting substrate is made of diamond.

7. The anode according to claim 5, wherein the anode member is made of at least one element selected from the group consisting of tungsten, tantalum, and molybdenum.

8. The anode according to claim 5, wherein the target layer is made of at least one element selected from the group consisting of tungsten, tantalum, and molybdenum.

9. The anode according to claim 1, wherein the supporting substrate is smaller in coefficient of thermal expansion than the anode member.

10. The anode according to claim 1, wherein the supporting substrate is bonded to the anode member via a ring-shaped bonding member.

11. The anode according to claim 1, wherein an end of the connecting electrode layer is configured to cover the anode member in a ring pattern.

12. The anode according to claim 1, wherein the target layer is positioned closer to a center in a tube radial direction than an opening of the anode member is.

13. The anode according to claim 1, wherein the connecting electrode layer comprises a third bonding boundary where the connecting electrode layer is bonded to the target layer, and wherein the third bonding boundary and the first bonding boundary are on the same side with respect to the connecting electrode layer.

14. The anode according to claim 1, wherein the supporting substrate comprises a transmissive target through which the X-ray generated in the target layer is transmitted.

15. An X-ray generating tube comprising:

the anode according to claim 1;

a cathode comprising an electron emitting source configured to emit electrons toward the target layer of the anode; and an insulating tube configured to insulate the anode and the cathode, and to form a vacuum container together with the anode and the cathode.

16. An X-ray generating apparatus comprising:

the X-ray generating tube according to claim 15; and a drive circuit configured to apply a tube voltage between the cathode and the anode of the X-ray generating tube.

17. A radiography system comprising:

the X-ray generating apparatus according to claim 16;

an X-ray detecting apparatus configured to detect an X-ray that has been emitted from the X-ray generating apparatus and transmitted through a subject; and a system control apparatus configured to control the X-ray generating apparatus and the X-ray detecting apparatus in a coordinated manner.

18. The anode according to claim 1, wherein the supporting substrate is secured to the anode member via a brazing material.

19. The anode according to claim 18, wherein a melting point of the connecting electrode layer is higher than that of the brazing material.

* * * * *